US009670786B2

(12) United States Patent
Read et al.

(10) Patent No.: US 9,670,786 B2
(45) Date of Patent: Jun. 6, 2017

(54) ROTARY BLADE WITH TIP INSERT

(71) Applicant: ROLLS-ROYCE PLC, London (GB)

(72) Inventors: Simon Read, Belper (GB); Matthew D Curren, Derby (GB)

(73) Assignee: ROLLS-ROYCE plc, London (GB)

( * ) Notice: Subject to any disclaimer, the term of this patent is extended or adjusted under 35 U.S.C. 154(b) by 91 days.

(21) Appl. No.: 14/728,618

(22) Filed: Jun. 2, 2015

(65) Prior Publication Data

US 2016/0003057 A1 Jan. 7, 2016

(30) Foreign Application Priority Data

Jul. 2, 2014 (GB) ..... 1411746.9

(51) Int. Cl.
*F01D 5/20* (2006.01)

(52) U.S. Cl.
CPC ..... *F01D 5/20* (2013.01); *F05D 2220/36* (2013.01); *F05D 2260/37* (2013.01); *F05D 2260/38* (2013.01); *F05D 2300/501* (2013.01); *F05D 2300/506* (2013.01)

(58) Field of Classification Search
CPC ..... F01D 5/20; F01D 5/147; F05D 2220/36; F05D 2300/501; F05D 2260/38; F05D 2260/37; F05D 2300/506; F05D 2240/307
See application file for complete search history.

(56) References Cited

U.S. PATENT DOCUMENTS 8,444,389 B1 5/2013 Jones et al.
2005/0175447 A1 8/2005 Garner
2013/0195633 A1 8/2013 Hildebrand et al.
2013/0236318 A1* 9/2013 Prue ..... F01D 5/005 416/223 A
2015/0192029 A1* 7/2015 Roberts, III ..... F01D 5/20 415/173.1

FOREIGN PATENT DOCUMENTS

EP 2 636 846 A1 9/2013
GB 2 378 733 A 2/2003
WO 2015/015207 A1 2/2015

OTHER PUBLICATIONS

Jan. 29, 2015 Search Report issued in Application No. GB1411746.9.
Oct. 23, 2015 Search Report in European Patent Application No. 15 17 0328.
"HYSOL EA 9394, Epoxy Paste Adhesive", https://tds.us.henkel.com/NA/UT/HNAUTTDS.nsf/web/D61948C932B43DF38525715C001BD400/$File/Hysol_EA_9394-EN.pdf, 2002, pp. 1-4.

* cited by examiner

*Primary Examiner* — Dwayne J White
*Assistant Examiner* — Theodore Ribadeneyra
(74) *Attorney, Agent, or Firm* — Oliff PLC

(57) ABSTRACT

A rotary blade tip insert for incorporation into a rotary blade, for example, a rotary fan blade in a gas turbine engine. The tip insert comprises a sleeve for insertion into a recess provided in said rotary blade. The sleeve has a radially outer end defining an opening, a radially inner end and opposing wall portions extending between said ends. The tip insert further comprises a tip element having a crown portion and a root portion for insertion into the opening of said sleeve.

17 Claims, 2 Drawing Sheets

ROTARY BLADE WITH TIP INSERT

FIELD

The present invention relates to a tip insert for incorporation into a rotary blade, and/or a rotary blade for example, a rotary fan blade in a gas turbine engine.

BACKGROUND

It is desirable to reduce the clearance between the tip of a rotary fan blade and the fan casing of a gas turbine engine in order to maximise fuel efficiency.

However, reducing the clearance between the fan blade tip and the fan casing can lead to undesirable rubbing of the fan blade tips on the fan casing.

It is known to provide a track liner on the interior surface of the fan casing to provide a shroud for the fan blade tips. The track liner is formed of an abradable material (e.g. an epoxy resin) which is abraded by the rotary fan blades to form channels in the track liner into which the fan blade tips extend. These abradable track liners have found some success with metallic fan blades (e.g. titanium blades) which are very durable but a disadvantage of these track liners is that the running clearance is set by the longest blade. These track liners are not appropriate for use with fan blades formed of composite material (e.g. fibre-reinforced plastic (or resin matrix) material) which are less durable and readily suffer blade tip damage.

It is known from US2013/0195633 to provide a rotary blade tip insert which is fitted into a slot in an aerofoil blade where the tip insert is formed of a material having a greater durability that the blade. For example, the blade is formed of aluminium and the tip insert is formed of anodized aluminium, titanium and/or ceramic. The tip insert is retained within the slot by mechanical mating, material attachment e.g. welding or by adhesive bonding. Once secured within the slot, the tip insert cannot move and thus cannot accommodate manufacturing/operational tolerances or extreme events such as bird strikes. Furthermore, the intimate contact between the tip insert and the slot means that heat (resulting from rubbing friction) and mechanical stresses are readily transferred from the tip insert to the blade.

There is a need for a tip insert that can accommodate manufacturing/operational tolerances and extreme events and/or which can reduce thermal/mechanical stress transfer from the tip insert to the fan blade.

SUMMARY OF THE INVENTION

In a first aspect, the present invention provides a tip insert for a rotary blade, the tip insert comprising:

a sleeve for insertion into a recess provided in said rotary blade, the sleeve having a radially outer end defining an opening, a radially inner end with wall portions extending between said ends; and a tip element having a crown portion and a root portion for insertion into the opening of said insert sleeve.

By providing a sleeve in which the tip element can be received, thermal/mechanical stress transfer from the tip insert to the fan blade can be reduced.

Optional features of the invention will now be set out. These are applicable singly or in any combination with any aspect of the invention.

In some embodiments, (e.g. in use), the crown portion of the tip element is spaced from the radially outer end of the sleeve and the root portion of the tip element is spaced from the radially inner of the sleeve.

By spacing the crown portion of the tip element from the radially outer end of the sleeve and the root portion of the tip element from the radially inner end of the sleeve, it is possible for the root portion of the tip element to move further into the sleeve. This allows accommodation of manufacturing/operational tolerances and extreme events such as bird strike. Furthermore, each blade can set its own running clearance when used with an abradable track liner thus minimising tip clearance and improving efficiency.

In some embodiments, (e.g. in use), the root portion of the tip element is spaced from at least one of said opposing wall portions of the sleeve.

By spacing the root portion of the tip element from at least one of the opposing walls of the sleeve, it is possible to further increase the thermal isolation of the tip element (which may reach temperatures exceeding 200° C. as a result of rub/abrasion contact with the fan casing) from the blade thus avoiding thermal degradation of the blade and bond line (between the blade and tip element). The spacing also further increases physical isolation of the tip element from the blade thus reducing mechanical stress damage to the blade.

In some embodiments, (e.g. in use) the root portion of the tip element is spaced from both opposing wall portions of the sleeve. In some embodiments, the sleeve comprises a major axis extending in a chord-wise direction (i.e. between the leading and trailing edges of the rotary blade) and the root portion of the tip element is spaced from the opposing wall portions aligned with the major axis.

In some embodiments, the root portion of the tip element is spaced from the radially inner end of the sleeve by a deformable seat. E.g. in use, the root portion of the tip element may abut the deformable seat and can depress into the deformable seat to accommodate tolerances and extreme events. The deformable seat may be formed, for example, of an elastomeric polymeric material or a cellular material such as a foam, sponge, honeycomb, biomimetic material formed of, for example, metal, polymer or ceramic.

In some embodiments, the tip insert further comprises a retention mechanism for securing the root portion within the sleeve.

In some embodiments, the retention mechanism acts to space the root portion from the wall portion(s) of the sleeve (e.g. from the opposing wall portions aligned with the major axis of the sleeve).

In some embodiments, the retention mechanism is a one-way retention mechanism for allowing substantially unimpeded insertion (in an insertion direction) of the root portion into the sleeve and for impeding withdrawal (in a withdrawal direction) of the root portion from the sleeve.

In some embodiments, the retention mechanism comprises one or more barbs/prongs depending either from the wall portion(s) of the sleeve (e.g. from the opposing wall portions aligned with the major axis of the sleeve) or the root portion of the tip element. In addition to retaining the root portion within the sleeve, the barb(s) act to space the root portion from the wall portion(s) of the sleeve to effect increased thermal and physical isolation of the tip element from the blade.

In some embodiments, the retention mechanism comprises a plurality of barbs, depending from the wall portion (s) of the sleeve (e.g. from the opposing wall portions aligned with the major axis of the sleeve) or from the root portion.

The barb(s) may be elongated in the direction of the major axis of the sleeve.

The plurality of barbs may be vertically spaced between the radially outer and radially inner ends on the opposing wall portions aligned with the major axis of the sleeve or vertically spaced along the length of the root portion. The spacing between the barbs helps to create air gaps which increase thermal isolation between the tip element and the sleeve/blade.

In some embodiments, the retention mechanism comprises slanted barbs. These may extend from the wall portion(s) of the sleeve (e.g. from the opposing wall portions aligned with the major axis of the sleeve) and, e.g. in use, abut the root portion of the tip element, spacing it from the walls of the sleeve. The slanted barbs are slanted in the insertion direction i.e. they are slanted away from the opening at the radially outer end of the sleeve.

The frictional resistance between the slanted barbs on the sleeve and the root portion can prevent the movement of the root portion in the withdrawal direction.

To increase the engagement between the root portion and the sleeve insert, the retention mechanism may further comprise serrations formed either on the wall portion(s) of the sleeve (e.g. the opposing wall portions aligned with the major axis of the sleeve) or the root portion of the tip element.

In embodiments where the retention mechanism comprises slanted barbs depending from the wall portion(s) of the sleeve (e.g. from the opposing wall portions aligned with the major axis of the sleeve), the retention mechanism may further comprise serrations formed on the root portion.

In some embodiments, the sleeve is formed of plastics material e.g. by injection moulding. Examples include Lytex® (a glass fibre reinforced epoxy composite) or Stanyl® (a polyamide).

In some embodiments, the sleeve further comprises a base at its radially inner end. The deformable seat may rest on the base of the sleeve.

In a second aspect, the present invention provides a rotary blade having a recess housing a tip insert according to the first aspect.

In some embodiments the sleeve is fixed into the blade recess by adhesive e.g. by epoxy adhesive.

In a third aspect, the present invention provides a rotary blade having a recess with a radially outer end defining an opening and a radially inner end with opposing wall portions extending between the ends, the rotary blade comprising a tip insert having a tip element with a crown portion and a root portion for insertion into the opening of said recess, wherein, e.g. in use:

(a) the crown portion of the tip element is spaced from the radially outer end of the recess and the root portion of the tip element is spaced from the radially inner end of the recess; and/or (b) the root portion of the tip element is spaced from at least one of said opposing wall portions of the recess.

By spacing the crown portion of the tip element from the radially outer end of the recess and the root portion of the tip element from the radially inner end of the recess, it is possible for the root portion of the tip element to move further into the recess. This allows accommodation of manufacturing/operational tolerances and extreme events such as bird strike. Furthermore, each blade can set its own running clearance when used with an abradable track liner thus minimising tip clearance and improving efficiency.

By spacing the root portion of the tip element from at least one of the opposing walls of the recess, it is possible to increase the thermal isolation of the tip element (which may reach temperatures exceeding 200° C. as a result of rub/abrasion contact with the fan casing) from the blade thus avoiding thermal degradation of the blade and bond line. The spacing also increases physical isolation of the tip element from the blade thus reducing mechanical stress damage to the blade.

In some embodiments, the root portion of the tip element is spaced from both opposing wall portions of the recess. In some embodiments, the recess comprises a major axis extending in a chord-wise direction (i.e. between the leading and trailing edges of the rotary blade) and the root portion of the tip element is spaced from the opposing wall portions aligned with the major axis.

In some embodiments, the root portion of the tip element is spaced from the radially inner end of the recess by a deformable seat. E.g. in use, the root portion of the tip element abuts the deformable seat and can depress into the deformable seat to accommodate tolerances and extreme events. The deformable seat may be formed, for example, of an elastomeric polymeric material or metallic foam.

In some embodiments, the tip insert further comprises a retention mechanism for securing the root portion within the recess.

In some embodiments, the retention mechanism acts to space the root portion from the wall portion(s) of the recess (e.g. from the opposing wall portions aligned with the major axis of the recess).

In some embodiments, the retention mechanism is a one-way retention mechanism for allowing substantially unimpeded insertion (in an insertion direction) of the root portion into the recess and for impeding withdrawal (in a withdrawal direction) of the root portion from the recess. For example, insertion of the root portion into the recess is relatively unimpeded compared to the withdrawal of the root portion from the recess.

In some embodiments, the retention mechanism comprises one or more barbs/prongs depending either from the wall portion(s) of the recess (e.g. from the opposing wall portions aligned with the major axis of the recess) or the root portion of the tip element. In addition to retaining the root portion within the recess, the barb(s) act to space the root portion from the wall portion(s) of the recess to effect increased thermal and physical isolation of the tip element from the blade.

In some embodiments, the retention mechanism comprises a plurality of barbs, depending from the wall portion (s) of the recess (e.g. from the opposing wall portions aligned with the major axis of the recess) or from the root portion.

The barb(s) may be elongated in the direction of the major axis of the recess.

The plurality of barbs may be vertically spaced between the radially outer and radially inner ends on the opposing wall portions aligned with the major axis of the recess or vertically spaced along the length of the root portion. The spacing between the barbs helps to create air gaps which increase thermal isolation between the tip element and the blade.

In some embodiments, the retention mechanism comprises slanted barbs. These may extend from the wall portion(s) of the recess (e.g. from the opposing wall portions aligned with the major axis of the recess) and, e.g. in use, abut the root portion of the tip element, spacing it from the walls of the recess. The slanted barbs are slanted in the insertion direction i.e. they are slanted away from the opening at the radially outer end of the recess.

The frictional resistance between the slanted barbs on the recess wall(s) and the root portion prevents the movement of the root portion in the withdrawal direction.

To increase the engagement of the root portion in the recess, the retention mechanism may further comprise serrations formed either on the wall portion(s) of the recess (e.g. the opposing wall portions aligned with the major axis of the recess) or the root portion of the tip element.

In embodiments where the retention mechanism comprises slanted barbs depending from the wall portion(s) of the recess (e.g. from the opposing wall portions aligned with the major axis of the recess), the retention mechanism may further comprise serrations formed on the root portion.

In some embodiments, the tip insert further comprises a sleeve for lining the recess in the rotary blade. The sleeve has a radially outer end defining an opening, a radially inner end and opposing wall portions extending between the ends.

Accordingly, e.g. in use, the crown portion of the tip element is spaced from the radially outer end of the sleeve and the root portion of the tip element is spaced from the radially inner end of the sleeve; and/or the root portion of the tip element is spaced from at least one of said opposing wall portions of the sleeve.

In these embodiments, the sleeve acts to further increase thermal and physical isolation of the tip element from the blade.

For embodiments comprising a sleeve, the retention mechanism described above is for securing the root portion within the sleeve.

The barb(s) and/or serrations described above as being provided on the wall(s) of the recess may be provided, instead, on the wall(s) of the sleeve, (e.g. on the wall(s) of the sleeve aligned with the major axis of the recess).

In some embodiments of the first to third second aspects, the crown portion and root portion of the tip element are integrally formed. For example, they may be integrally formed of titanium. They may be formed, for example, by hot isotactic pressing (HIP), metal injection moulding (MIM) or additive layer manufacture (ALM).

In some embodiments of the first to third aspects, the crown portion is provided with a coating such as a cubic boron nitride (CBN) coating for increasing its hardness.

In some embodiments of the first to third aspects, the crown portion has a pitched upper surface, distal the root portion. The coating may be applied to the pitched surface.

The blade of the second or third aspects has a pressure face and a suction face, each extending between a leading and trailing edge. The recess e.g. a slotted recess is provided in a chord-wise direction between the leading and trailing edges towards the tip portion of the blade.

The blade of the second or third aspects may be formed of a metal such as titanium or it may be formed of a composite material e.g. a fibre reinforced plastic (or resin matrix) composite such as a carbon fibre/epoxy resin composite.

Where the blade is formed of a composite material e.g. a fibre reinforced plastic (or resin matrix) composite, metal cladding, e.g. titanium cladding, may be provided on one or both of the pressure and suction faces of the blade.

In a fourth aspect, the present invention provides a gas turbine engine having a fan comprising a plurality of blades according to the second or third aspects.

BRIEF DESCRIPTION OF THE DRAWINGS

Embodiments of the invention will now be described by way of example with reference to the accompanying drawings in which.

DETAILED DESCRIPTION

Figure 1:
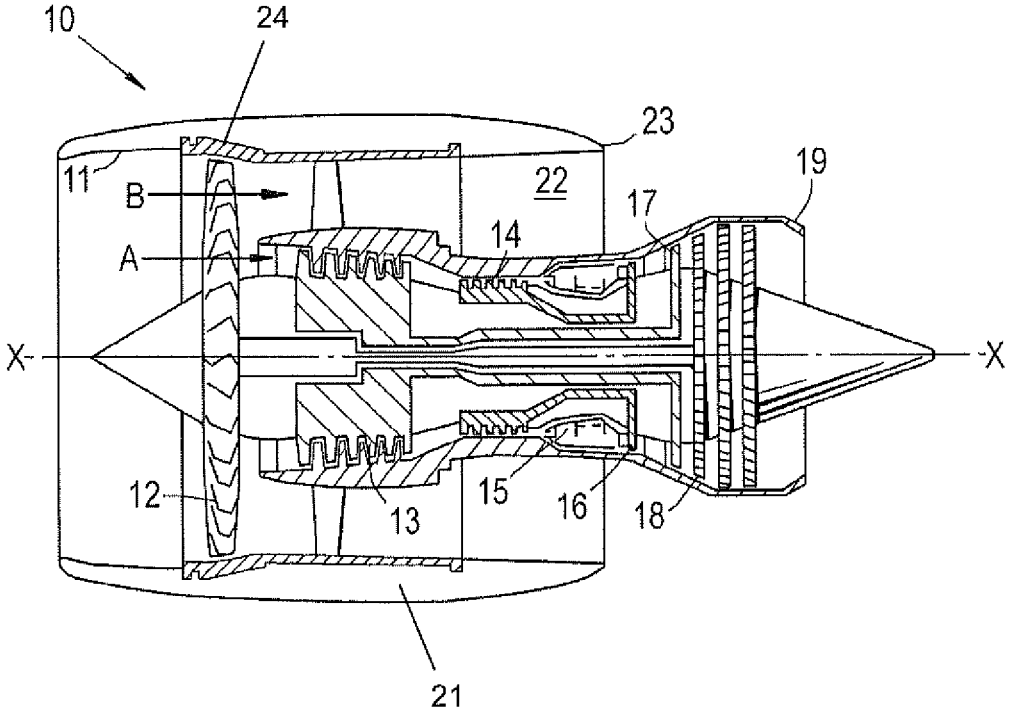
FIG. 1 shows a cross-section through a ducted fan gas turbine engine.

With reference to FIG. 1, a ducted fan gas turbine engine is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

The fan 12 comprises a plurality of fan blades (formed of a fibre-reinforced plastic (or resin matrix) material such as carbon-fibre/epoxy resin composite) which are surrounded by a fan casing 24 having an abradable, epoxy resin fan track liner on its inner surface proximal the fan 12.

Figure 2:
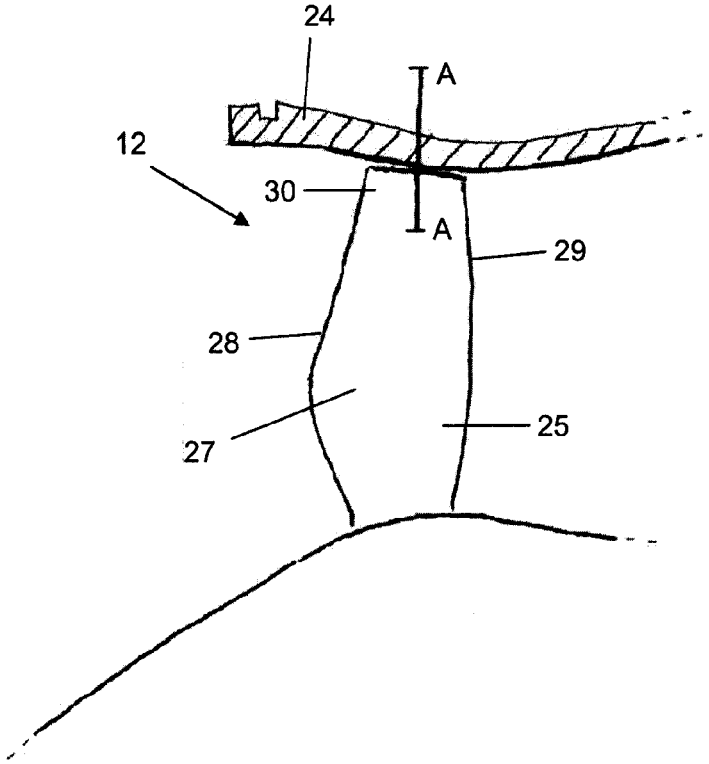
FIG. 2 shows a cross-section through a fan of the gas turbine engine.
Figure 3:
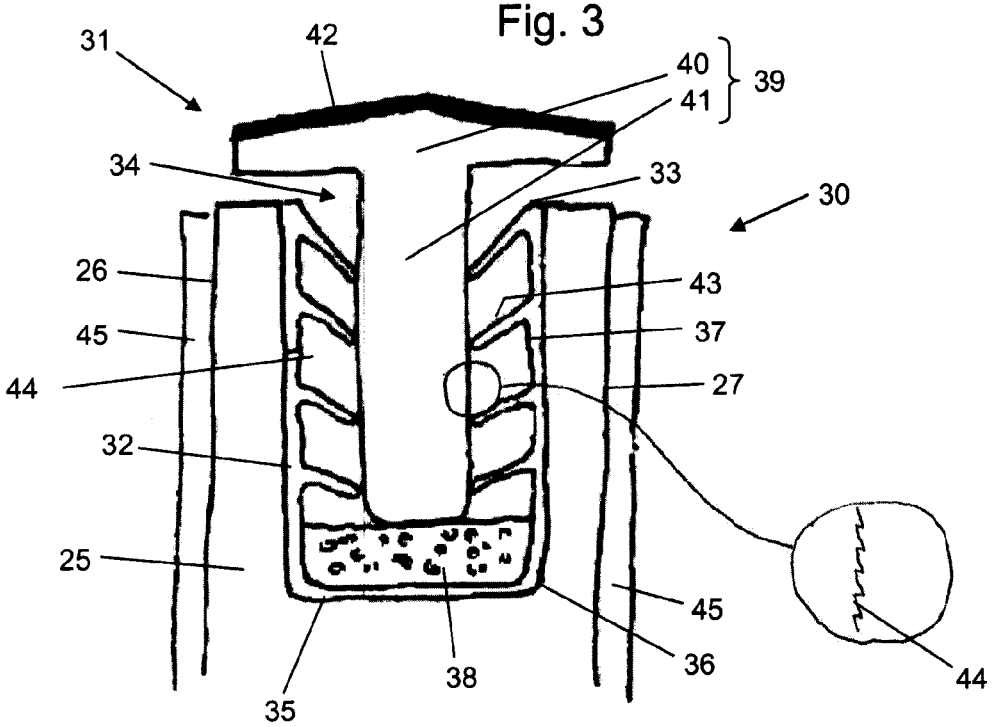
FIG. 3 shows a tip insert.

FIG. 2 shows an axial cross section through the fan 12. The fan blade 25 has a suction face 26 (not shown), a pressure face 27, a leading edge 28 and a trailing edge 29. FIG. 3 shows a cross-sectional view of the tip portion 30 of the fan blade 25 along line A-A in FIG. 2.

The composite fan blade 25 has titanium cladding 45 on the suction and pressure faces 26, 27. The tip portion 30 has a slotted recess extending in a chord-wise direction between the leading and trailing edges 28, 29. A tip insert 31 is inserted into the slotted recess in the tip portion 30 of the fan blade 25.

The tip insert comprises a sleeve 32 which is fixed into the blade recess by adhesive e.g. by epoxy adhesive.

The sleeve 32 is formed of plastics material e.g. by injection moulding, and has a radially outer end 33 defining an opening 34, a base 35 provided at a radially inner end 36 and wall portions 37 extending between the ends, 33, 36. The wall portions 37 are aligned with a major axis of the sleeve/slotted recess i.e. the axis extending between in the chord-wise direction between the leading and trailing edges.

A deformable seat 38 formed of metallic foam or an elastomeric polymer material is provided on the base 35 at the radially inner end 36 of the sleeve 32.

The tip insert 31 further comprises a titanium tip element 39 having a crown portion 40 and a root portion 41 which are integrally formed. The crown portion 40 is provided with a coating 42 (such as a cubic boron nitride (CBN) coating) on a pitched upper surface for increasing its hardness.

A series of vertically spaced, laterally opposed slanted barbs 43, slanting towards the radially inner end 36/base 35 of the sleeve 32 are provided extending from the wall portions 37 which are aligned with the major axis of the sleeve. The barbs act to provide a one-way retention mechanism for allowing substantially unimpeded insertion (in an insertion direction) of the root portion 41 into the sleeve 32 and for impeding withdrawal (in a withdrawal direction) of the root portion 41 from the sleeve 32.

When the root portion 41 is inserted into the sleeve 32 in the insertion direction, the slanted barbs 43 are deformed by contact pressure with the root portion 41 and the resistance between the slanted barbs 43 on the sleeve 32 and the root portion 41 secures the root portion within the sleeve 32 by preventing movement of the root portion 41 in the withdrawal direction.

In addition to retaining the root portion 41 within the sleeve 32, the slanted barbs 43 act to space the root portion 41 from the wall portions 37 of the sleeve 32 to effect thermal and physical isolation of the tip element 39 from the blade 25. The spacing between the slanted barbs 43 helps to create air gaps 44 which increase thermal isolation between the tip element 39 and the blade 25.

To increase the engagement between the root portion 41 and the sleeve 32, the retention mechanism further comprises serrations 44 (shown in the inset) on the root portion 41 which engage with the slanted barbs 43 to prevent movement of the root portion 41 in the withdrawal direction.

When the root portion 41 is retained in the sleeve 32, it is in an abutting relationship with the deformable seat 38 which spaces the root portion 41 from the radially inner end 36 of the sleeve 32. In this way, the tip element 39 is free to move in the insertion direction to accommodate manufacturing/operational tolerances and extreme events.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. A tip insert for a rotary blade, the tip insert comprising:

a sleeve for insertion into a recess provided in said rotary blade, the sleeve having a radially outer end defining an opening, a radially inner end and wall portions extending between said ends; and a tip element having a crown portion and a root portion for insertion into the opening of said sleeve, wherein the crown portion of the tip element is spaced from the radially outer end of the sleeve.

2. A tip insert according to claim 1 wherein the root portion of the tip element is spaced from the radially inner end of the sleeve.

3. A tip insert according to claim 1, wherein the root portion of the tip element is spaced from at least one of said opposing wall portions of the sleeve.

4. A tip insert according to claim 3, wherein the root portion of the tip element is spaced from the radially inner end of the sleeve and from the opposing wall portions of the sleeve.

5. A tip insert according to claim 1 wherein the tip insert further comprises a deformable seat provided at the radially inner end of the sleeve to space the root portion from the radially inner end of the sleeve.

6. A tip insert for a rotary blade, the tip insert comprising:

a sleeve for insertion into a recess provided in said rotary blade, the sleeve having a radially outer end defining an opening, a radially inner end and wall portions extending between said ends; and a tip element having a crown portion and a root portion for insertion into the opening of said sleeve, wherein the tip insert further comprises a retainer configured to secure the root portion in the sleeve and to space the root portion from the opposing wall portion(s) of the sleeve.

7. A tip insert according to claim 6 wherein the retainer is a one-way retainer for allowing unimpeded insertion of the root portion into the sleeve and for impeding withdrawal of the root portion from the sleeve.

8. A tip insert according to claim 7 wherein the retainer comprises one or more slanted barbs depending either from the opposing wall portion(s) of the sleeve or from the root portion of the tip element.

9. A tip insert according to claim 8 wherein the retainer comprises a plurality of slanted barbs depending from opposing wall portions aligned with a major axis of the sleeve.

10. A tip insert according to claim 9 wherein the plurality of barbs are radially spaced between the radially outer and radially inner ends on the opposing wall portions of the sleeve.

11. A tip insert according to claim 6 wherein the retainer further comprises serrations formed on the root portion of the tip element.

12. A rotary blade having a recess with a radially outer end defining an opening, a radially inner end and wall portions extending between said ends, the rotary blade comprising a tip insert having a tip element with a crown portion and a root portion for insertion into the opening of said recess, wherein:

(a) the crown portion of the tip element is spaced from the radially outer end of the recess and the root portion of the tip element is spaced from the radially inner end of the recess; and (b) the root portion of the tip element is spaced from said opposing wall portions of the recess.

13. A blade according to claim 12 wherein the blade further comprises a deformable seat provided at the radially inner end of the recess to space the root portion from the radially inner end of the recess.

14. A blade according to claim 12 wherein the tip insert further comprises a sleeve for lining the recess in the rotary blade, the sleeve having a radially outer end defining an opening, a radially inner end and opposing wall portions extending between the ends, such that the crown portion of the tip element is spaced from the radially outer end of the sleeve and the root portion of the tip element is spaced from the radially inner end of the sleeve; and/or the root portion of the tip element is spaced from at least one of said opposing wall portions of the sleeve.

15. A blade according to claim 14 wherein the blade further comprises a retainer configured to secure the root portion in the recess or sleeve and for spacing the root portion from the opposing wall portion(s) of the recess or sleeve.

16. A blade according to claim 15 wherein the retainer is a one-way retainer for allowing unimpeded insertion of the root portion into the recess or sleeve and for impeding withdrawal of the root portion from the recess or sleeve.

17. A gas turbine engine having a fan comprising a plurality of blades according to claim 12.

* * * * *